US006415957B1

(12) United States Patent
Michaels et al.

(10) Patent No.: US 6,415,957 B1
(45) Date of Patent: Jul. 9, 2002

(54) APPARATUS FOR DISPENSING A HEATED POST-FOAMING GEL

(75) Inventors: Kenneth W. Michaels, Spring Grove, IL (US); John A. Heathcock, Racine, WI (US); Edward J. Kunesh, Franksville, WI (US); David P. Mather, Milwaukee, WI (US); Scott W. Demarest, Caledonia, WI (US); Darren K. Robling, Racine, WI (US); Thomas J. Szymczak, Franksville, WI (US); Clifford S. Eagleton, Chicago, IL (US); Eric B. Gach, Niles, IL (US); Paul J. Golko, Crystal Lake, IL (US); Dennis W. Gruber, Arlington Heights, IL (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 09/722,860

(22) Filed: Nov. 27, 2000

(51) Int. Cl.[7] ..... B67D 5/62

(52) U.S. Cl. ..... 222/146.3; 222/402.13; 219/214

(58) Field of Search ..... 222/146.5, 146.2, 222/146.3, 402.13, 402.15, 325, 402.1; 219/214

(56) References Cited

U.S. PATENT DOCUMENTS

| | | | | |
|---|---|---|---|---|
| 2,215,491 | A | 9/1940 | Ziegler | 221/60 |
| 2,550,825 | A | 5/1951 | Kolodie | 38/77 |
| 2,873,351 | A | 2/1959 | Lannert | 219/39 |
| 2,914,221 | A | 11/1959 | Rosenthal | 222/146 |
| 2,955,191 | A | 10/1960 | Galgano et al. | 219/43 |
| 2,974,453 | A | 3/1961 | Meshberg | 53/29 |
| 3,069,528 | A | 12/1962 | Gardner | 219/39 |
| 3,095,122 | A | 6/1963 | Lewiecki et al. | 222/146 |
| 3,098,925 | A | 7/1963 | Flouts et al. | 219/39 |
| 3,111,967 | A | 11/1963 | Bullard | 141/11 |
| 3,144,174 | A | 8/1964 | Abplanalp | 222/146 |
| 3,171,572 | A | 3/1965 | Reich et al. | 222/146 |
| 3,207,369 | A | 9/1965 | Rossi | 222/23 |
| 3,241,723 | A | 3/1966 | Lerner | 222/146 |
| 3,263,744 | A | 8/1966 | MacKeown | 165/47 |
| 3,266,674 | A | 8/1966 | Martin | 222/146 |
| 3,292,823 | A | 12/1966 | Weidman et al. | 222/146 |
| 3,307,747 | A | 3/1967 | Pacitti | 222/146 |
| 3,312,375 | A | 4/1967 | Williams | 222/146 |
| 3,314,572 | A | 4/1967 | Pungitore | 222/136 |
| 3,326,469 | A | 6/1967 | Abplanalp et al. | 239/308 |
| 3,335,910 | A | 8/1967 | Rossi | 222/54 |
| 3,338,476 | A | 8/1967 | Marcoux | 222/146 |
| 3,341,079 | A | 9/1967 | Marraffino | 222/136 |
| 3,343,718 | A | 9/1967 | Siegel et al. | 222/1 |
| 3,347,422 | A | 10/1967 | Mean et al. | 222/146 |
| 3,358,882 | A | 12/1967 | Mathison | 222/80 |
| 3,370,756 | A | 2/1968 | McKinnie | 222/146 |
| 3,372,840 | A | 3/1968 | Kelley | 222/146 |
| 3,373,904 | A | 3/1968 | Lowry | 222/146 |
| 3,399,810 | A | 9/1968 | Burne | 222/146 |

(List continued on next page.)

OTHER PUBLICATIONS

Sixteen (16) Photographs of Shave Foam Dispensers.

*Primary Examiner*—Philippe Derakshani

(57) ABSTRACT

Apparatus for dispensing a heated gel includes a housing having a recess therein, a coupling assembly disposed in the housing and adapted to retain a pressurized gel container in the recess and a heater assembly disposed in the housing. The heater assembly includes a heater selectively operable to develop heat and a heat exchanger in heat transfer relationship with the heater and having a chamber for receiving a quantity of gel. The heater assembly further includes a first valve in fluid communication with a first portion of the chamber and operable to expose the chamber to pressurized gel and a second valve in fluid communication with a second portion of the chamber and operable to allow dispensing of gel without substantial foaming.

33 Claims, 12 Drawing Sheets

U.S. PATENT DOCUMENTS 3,437,791 A 4/1969 Gardner ..... 219/301
3,446,402 A 5/1969 Gasser et al. ..... 222/146
3,454,745 A 7/1969 Stone ..... 219/415
3,476,293 A 11/1969 Marcoux ..... 222/146
3,492,460 A 1/1970 Reich ..... 219/291
3,497,110 A 2/1970 Bombero et al. ..... 222/146
3,498,504 A 3/1970 Wilkins ..... 222/146
3,518,410 A 6/1970 Dillarstone ..... 219/300
3,527,922 A 9/1970 Reich et al. ..... 219/308
3,541,581 A 11/1970 Monson ..... 252/90
3,550,649 A 12/1970 Meshberg ..... 141/3
3,556,171 A 1/1971 Gangwisch et al. ..... 141/3
3,559,850 A 2/1971 Barkl ..... 222/146
3,563,419 A 2/1971 Coerver, Jr. ..... 222/193
3,576,279 A 4/1971 Ayres ..... 222/146
3,578,945 A 5/1971 Ayres et al. ..... 219/214
3,588,467 A 6/1971 Grosjean ..... 219/214
3,588,469 A 6/1971 Dillarstone ..... 219/308
3,596,056 A 7/1971 Dillarstone ..... 219/300
3,618,810 A 11/1971 Wilson ..... 220/24 R
3,644,707 A 2/1972 Costello ..... 219/302
RE27,304 E 3/1972 Flowers ..... 222/146
3,698,453 A 10/1972 Morane et al. ..... 141/349
3,710,985 A 1/1973 Baum ..... 222/146
3,713,464 A 1/1973 Nigro ..... 141/20
3,722,753 A 3/1973 Miles ..... 222/146 HA
3,733,460 A 5/1973 Ryckman, Jr. ..... 219/308
3,749,880 A 7/1973 Meeks ..... 219/214
3,758,002 A 9/1973 Doyle et al. ..... 222/146
3,790,033 A 2/1974 Ciaffone ..... 219/146
3,817,297 A 6/1974 King ..... 141/20
3,823,851 A 7/1974 Waters ..... 222/146 HA
3,843,022 A 10/1974 Radcliffe et al. ..... 222/146
3,891,827 A 6/1975 Wyse ..... 219/302
3,894,659 A 7/1975 Focht ..... 222/94
3,907,175 A 9/1975 Haas ..... 222/402.13
3,933,276 A 1/1976 Packham et al. ..... 222/146
3,990,612 A 11/1976 Gasser ..... 222/146
3,997,083 A 12/1976 McNair ..... 222/146
4,000,834 A 1/1977 Whitley ..... 222/180
4,024,987 A 5/1977 Myles ..... 222/146 HA
4,027,786 A 6/1977 Ryckman, Jr. ..... 222/146
4,047,876 A 9/1977 Rice ..... 431/7
4,056,707 A 11/1977 Farnam ..... 219/302
4,067,480 A 1/1978 Gasser ..... 222/146 HA
4,069,949 A 1/1978 Ryckman, Jr. ..... 222/146 HA
4,202,387 A 5/1980 Upton ..... 141/360
4,329,569 A 5/1982 Hjortsberg et al. ..... 219/535
4,421,973 A 12/1983 Lou ..... 219/301
4,439,416 A 3/1984 Cordon et al. ..... 424/47
4,442,959 A 4/1984 Del Bon et al. ..... 222/402.24
4,445,627 A 5/1984 Horak ..... 222/54
4,493,444 A 1/1985 Del Bon et al. ..... 222/402.22
4,522,318 A 6/1985 Del Bon ..... 222/402.24
4,532,690 A 8/1985 Del Bon et al. ..... 29/451
4,658,979 A 4/1987 Mietz et al. ..... 220/209
4,918,818 A 4/1990 Hsieh ..... 30/34
5,060,829 A 10/1991 Evans ..... 222/146.3
5,098,414 A 3/1992 Walker ..... 604/291
5,121,541 A 6/1992 Patrakis ..... 30/41
5,267,399 A 12/1993 Johnston ..... 30/41
5,345,980 A 9/1994 Burt et al. ..... 141/3
5,358,147 A 10/1994 Adams et al. ..... 222/183
5,489,047 A 2/1996 Winder ..... 222/325
5,513,771 A 5/1996 Cote ..... 221/75
5,544,701 A 8/1996 Elder ..... 165/80.5
5,647,408 A 7/1997 Erste et al. ..... 141/20
5,671,325 A 9/1997 Roberson ..... 392/442
5,700,991 A 12/1997 Osbern ..... 219/430
5,811,766 A 9/1998 Fabrikant et al. ..... 219/521
5,832,972 A 11/1998 Thomas et al. ..... 141/360
5,858,343 A 1/1999 Szymczak ..... 424/73
5,881,766 A 3/1999 Schlesch et al. ..... 137/597
5,975,152 A 11/1999 Kluge ..... 141/20
6,039,212 A 3/2000 Singh ..... 222/30
6,053,373 A 4/2000 Sutton et al. ..... 222/402.13
6,056,160 A 5/2000 Carlucci et al. ..... 222/146.3
6,092,569 A 7/2000 Simmel et al. ..... 141/231
6,105,633 A 8/2000 Pedersen et al. ..... 141/18
6,158,486 A 12/2000 Olson et al. ..... 141/351
6,170,537 B1 1/2001 Lasserre ..... 141/3
6,174,319 B1 1/2001 Simmel et al. ..... 141/346
6,311,868 B1 11/2001 Krietemeier et al. ..... 222/1

FIG. 14
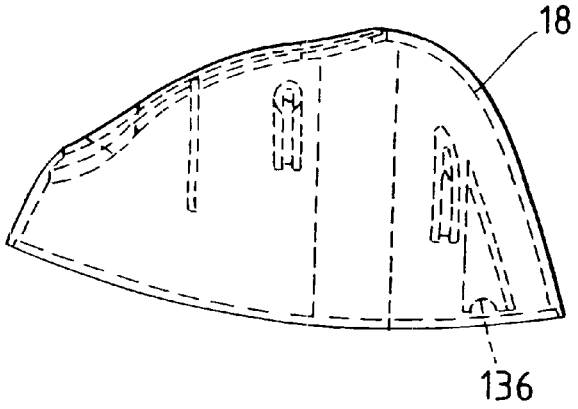
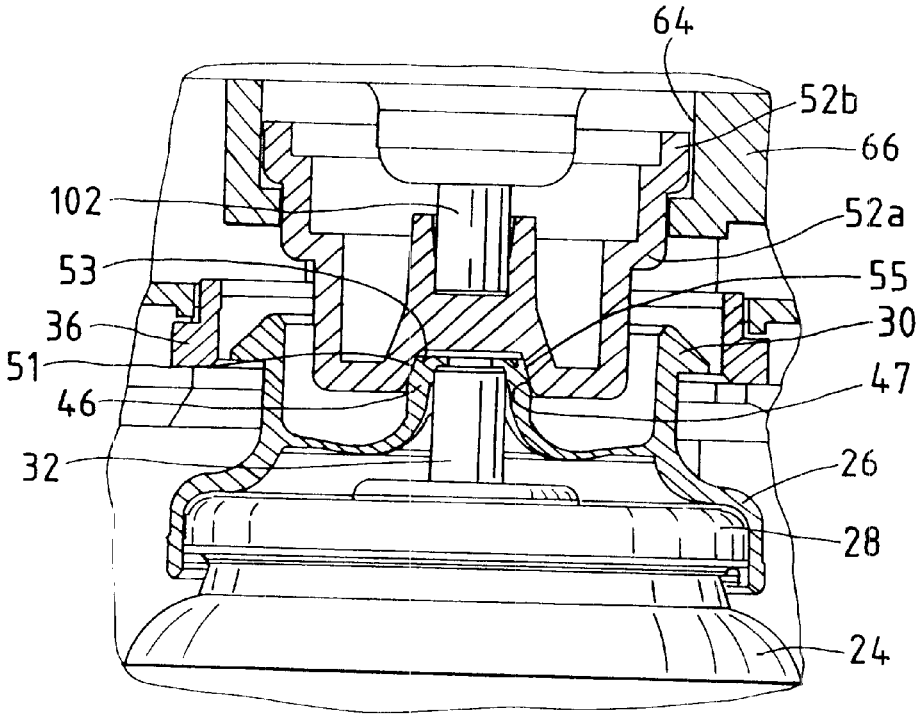
FIG. 15

APPARATUS FOR DISPENSING A HEATED POST-FOAMING GEL

TECHNICAL FIELD

The present invention relates generally to dispensing apparatus, and more particularly to a dispenser that dispenses a heated post-foaming gel.

BACKGROUND ART

Shaving lather dispensers that dispense heated shaving lather have been known for some time. For example, Rossi U.S. Pat. No. 3,335,910 discloses a heatable shaving lather dispenser including a housing, an elongate heat conductive block and a heater disposed in a channel in the block. A lather carrying duct extends through the block in heat transfer relationship with the heater and a first end of the duct is in fluid communication with an aerosol container. A second end of the duct has a selectively operable valve disposed therein. The duct is maintained at container pressure and the valve is actuable to dispense heated lather into the hand of a user.

Wilkins U.S. Pat. No. 3,498,504 discloses a heated aerosol lather dispenser having a casing, a lather-containing pressurized aerosol container retained in the casing and a head disposed above the aerosol container. The head includes an electrically heated block having a passage therethrough in fluid communication with the lather in the container. A valved outlet is provided between the passage and a discharge spout and is selectively actuable to dispense lather.

Post-foaming shaving materials have been developed which are designed to be dispensed in gel form. The post-foaming shave gel may then be applied to the skin of the user and, in the course of such application, the post-foaming shave gel is worked in a fashion that causes the gel to foam. While such gels are effective to prepare the skin of the user for shaving, it is believed that the skin preparation effect and/or shaving comfort are enhanced when the gel is heated and then applied to the skin. However, known dispensing devices, such those disclosed in the Rossi and Wilkins patents described above, are not designed specifically for use with such gels, and, in fact, use of such dispensers and can result in undesirable premature foaming of the gel.

SUMMARY OF THE INVENTION

In accordance with one aspect of the present invention, an apparatus for dispensing a heated gel includes a housing having a recess therein, a coupling assembly disposed in the housing and adapted to retain a pressurized gel container in the recess and a heater assembly disposed in the housing. The heater assembly includes a heater selectively operable to develop heat and a heat exchanger in heat transfer relationship with the heater and having a chamber for receiving a quantity of gel. The heater assembly further includes a first valve in fluid communication with a first portion of the chamber and operable to expose the chamber to pressurized gel and a second valve in fluid communication with a second portion of the chamber and operable to allow dispensing of gel without substantial foaming.

A further alternative aspect of the present invention comprehends a combination of a dispensing apparatus and a can of pressurized shaving gel. The can includes a can valve and a coupling cap having a circumferential flange. The dispensing apparatus includes a housing having a recess therein wherein the can is disposed in the recess, a coupling assembly disposed in the housing and engaging the circumferential flange of the coupling cap and a heater assembly disposed in the housing. The heater assembly includes a heater selectively operable to develop heat and a heat exchanger in heat transfer relationship with the heater and having a chamber. The heater assembly further includes a first valve in fluid communication with a first portion of the chamber and engageable to move the can valve and the first valve to open positions to expose the chamber to pressurized shaving gel and a second valve in fluid communication with a second portion of the chamber and operable to allow dispensing of gel without substantial foaming.

Other aspects and advantages of the present invention will become apparent upon consideration of the following detailed description.

BRIEF DESCRIPTION OF THE DRAWINGS

FIGS. 13 and 14 are full sectional views of the collar portion and upper portion, respectively; and FIG. 15 is a full sectional view of an alternative embodiment of the present invention.

DESCRIPTION OF THE PREFERRED EMBODIMENTS

Figure 1:
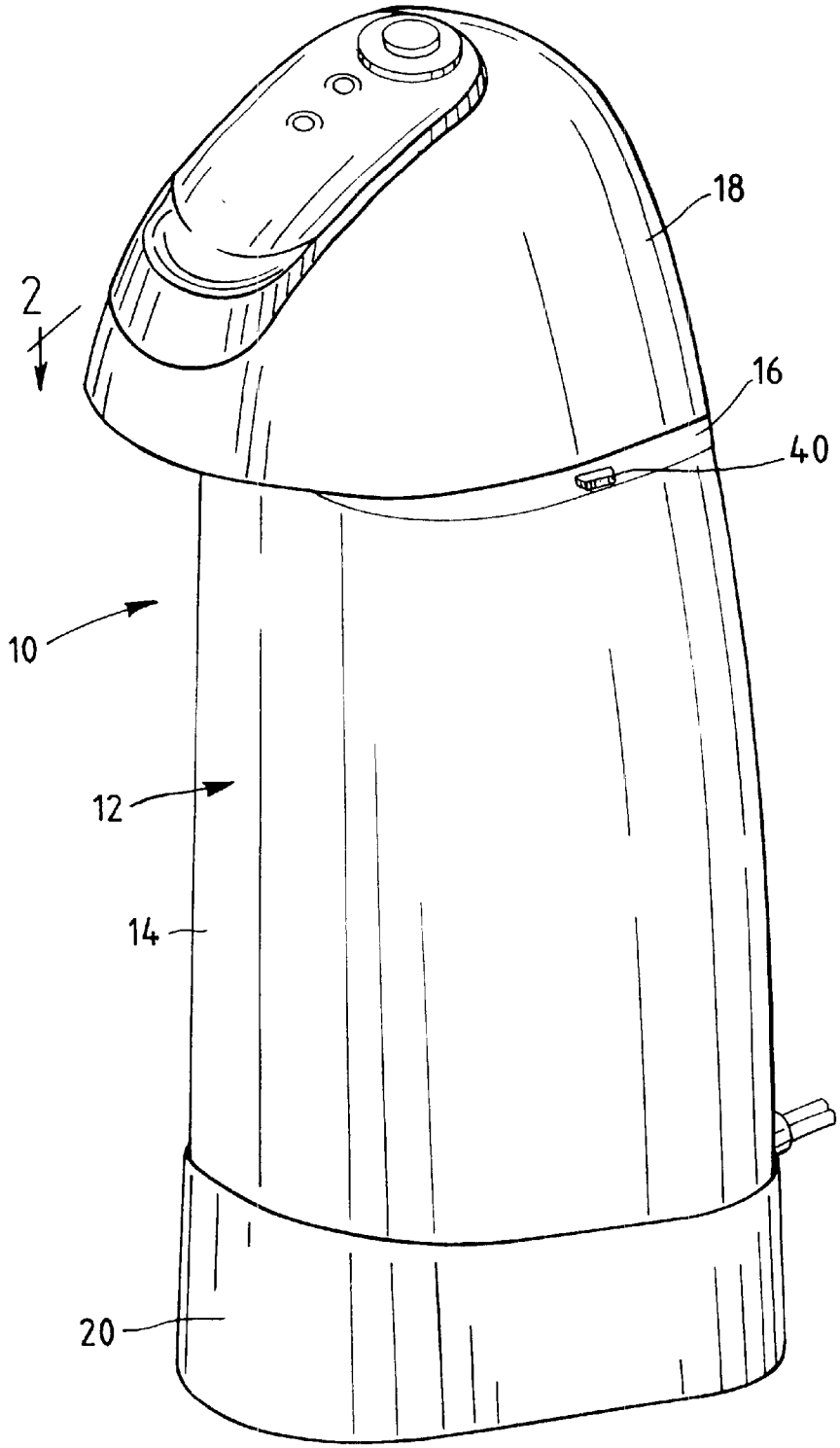
FIG. 1 is an isometric view of an apparatus according to the present invention.
Figure 2:
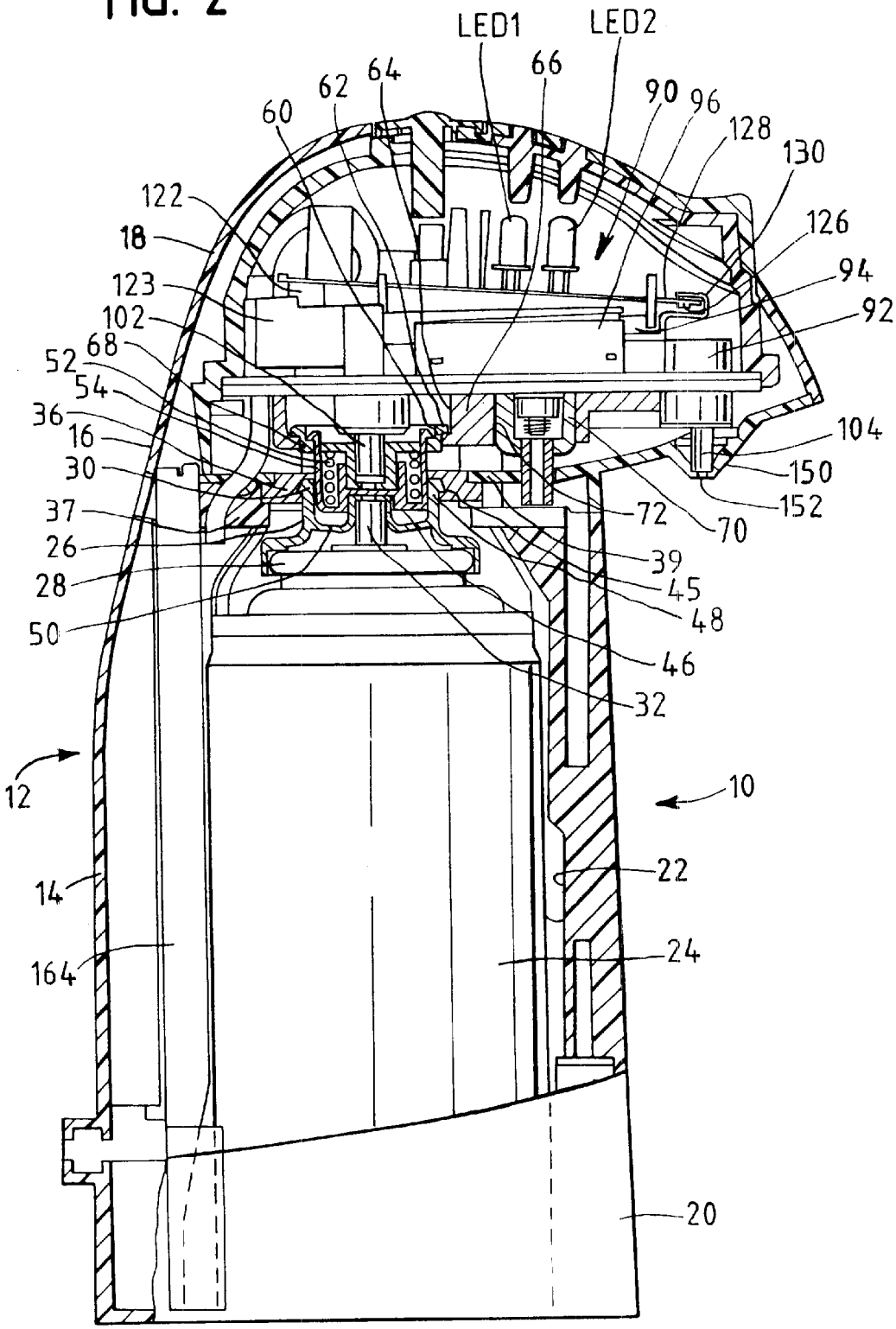
FIG. 2 is a partial sectional view of the apparatus of FIG. 1 together with a can of pressurized shave gel taken generally along the lines 2—2 of FIG. 1.
Figure 3:
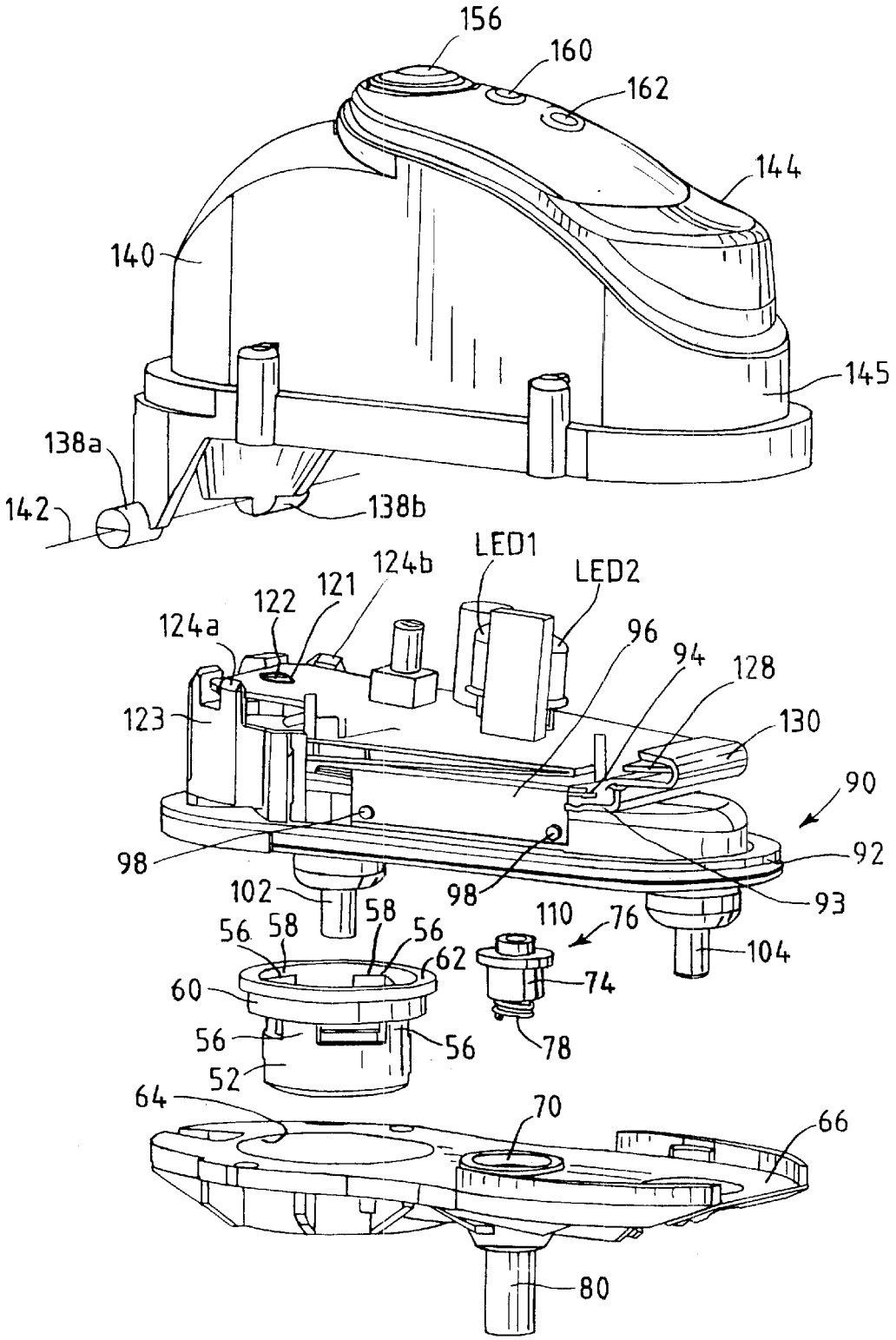
FIG. 3 is an exploded and enlarged isometric view of a portion of the apparatus of FIG. 1.
Figure 4:
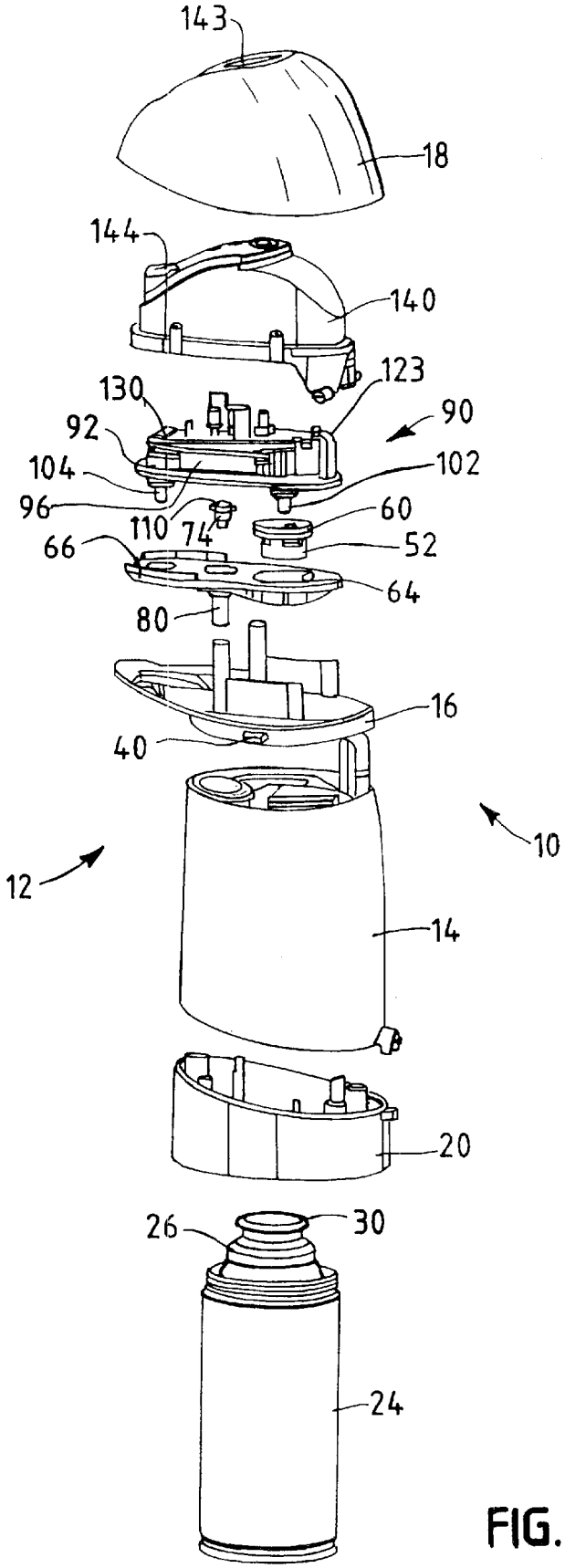
FIG. 4 is an exploded isometric view of the rear of the apparatus of FIG. 2.

Referring now to FIGS. 1, 2 and 4, a dispensing apparatus 10 according to the present invention includes a housing 12 having a main body portion 14 joined in any suitable fashion, such as by screws, to a collar portion 16 and an upper portion 18. The main body portion 14 is further joined by screws or any other suitable fastener(s) to a base portion 20. The portions 14, 16, 18 and 20 are fabricated of any suitable material, such as polycarbonate.

The housing 12 defines a recess 22 (FIG. 2) within which may be disposed a pressurized can 24 containing shaving gel. The post-foaming shave gel preferably is of the type disclosed in Szymczak U.S. Pat. No. 5,858,343, owned by the assignee of the present application and the disclosure of which is incorporated by reference herein.

Figure 5:
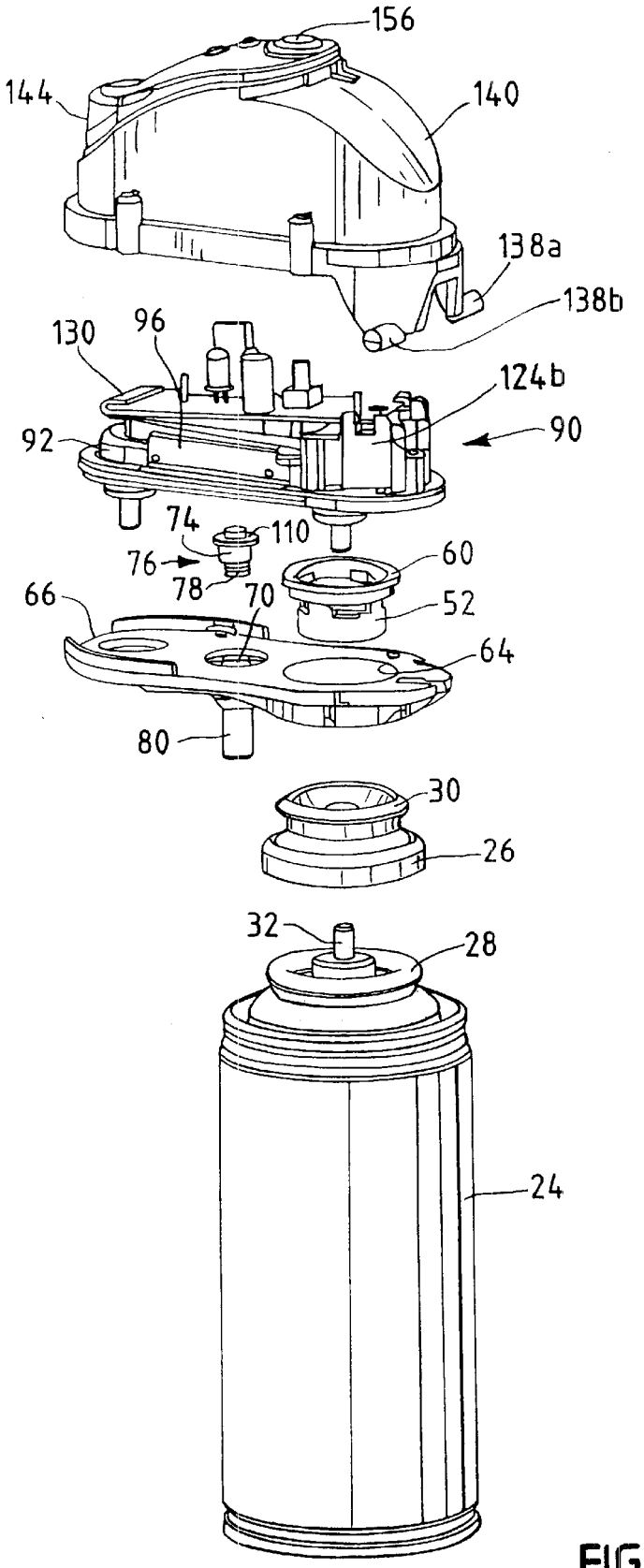
FIG. 5 is an exploded and enlarged isometric view of a portion of the apparatus of FIG. 4.
Figure 6:
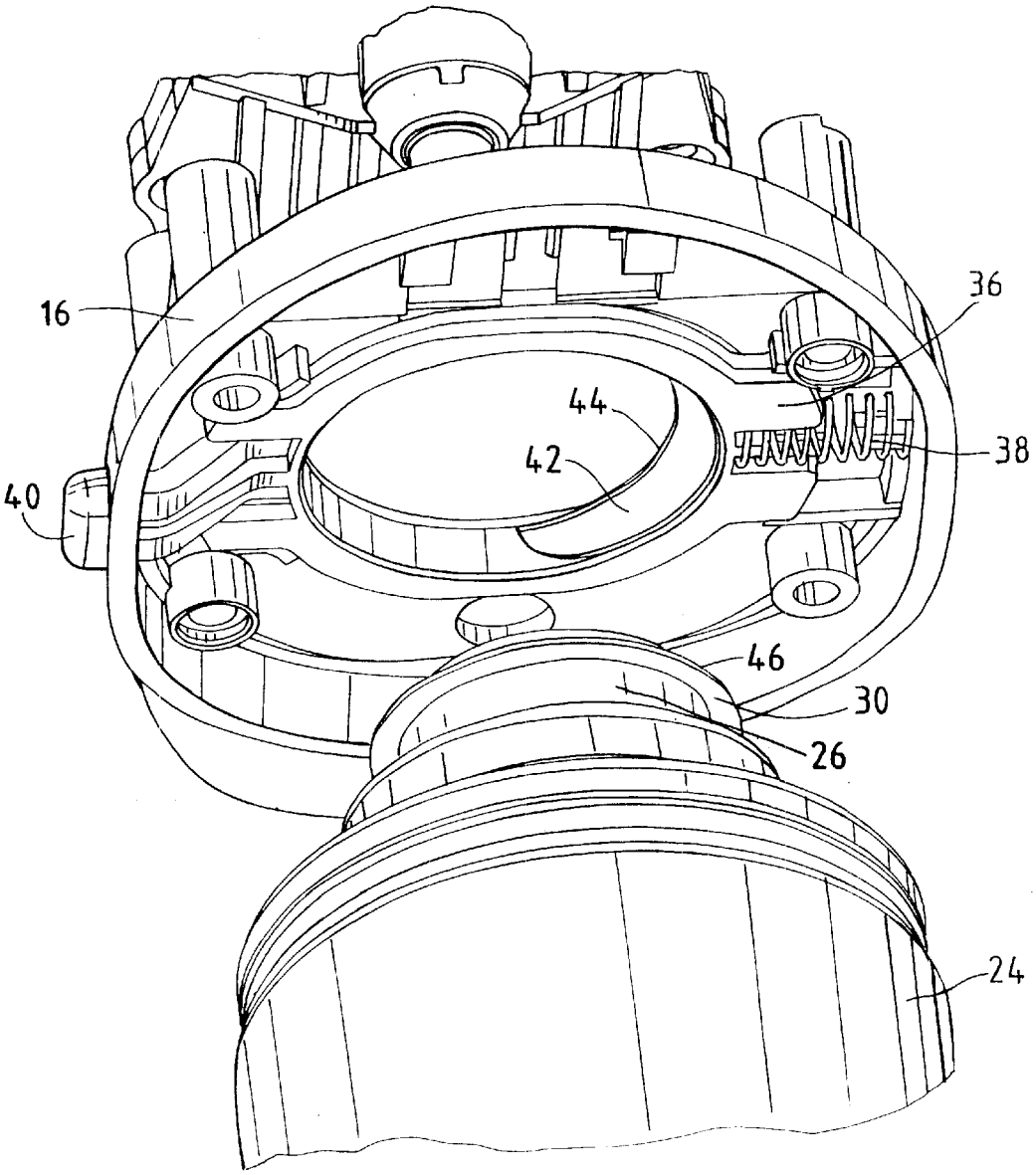
FIG. 6 is an enlarged isometric view of the underside of a collar portion illustrating a can coupling assembly.

Referring also to FIG. 5, the can 24 includes a coupling cap 26 carried on an upper annular rim 28. A series of three inwardly-extending tabs (not shown) are carried by the cap 26 at a lower end thereof and the tabs are disposed below the rim 28 to maintain the cap 26 on the can 24. The coupling cap 26 includes an annular flange 30 and surrounds a conventional resilient spring-loaded aerosol valve 32 disposed in the can 24. Referring to FIGS. 2, 4 and 6, the collar portion 16 includes a coupling assembly 34 comprising a coupling ring 36 that is biased toward an engaged position by a spring 38. The coupling ring 36 is disposed between and restrained against axial movement by an upper wall 37 of the main body portion 14 and a wall 39 of the collar portion 16 (FIG. 2). The coupling ring 36 may be moved against the force of the spring 38 toward a disengaged position by pushing on a button 40 extending outwardly through an aperture in the collar portion 16. When the can 24 is inserted upwardly in the recess 22, the annular flange 30 engages a sloped surface 42 (FIG. 6), thereby displacing the coupling ring 36 toward the disengaged position until an edge 44 of the sloped surface 42 reaches an outer edge 45 of the annular flange 30. At this point, the edge 44 of the sloped surface 42 rides over the edge 45 and the coupling ring 36 snaps under the force of the spring 38 into the engaged position whereby the portion of the coupling ring 36 carrying the sloped surface 42 is disposed in interfering relationship with the annular flange 30. In addition, also referring to FIG. 12, as the can 24 is being pushed upwardly, a tapered outer surface 47 of a central portion 46 of the coupling cap 26 contacts a sloped surface 51 of a coupling cover 52 that is resiliently biased by a spring 54. The central portion 46 of the coupling cap 26 is connected to an outer wall 48 of the cap 26 by a series of four fingers 50 (two of which are visible in FIGS. 2 and 12). Preferably, the sloped surface 51 forms an angle relative to a horizontal line in FIG. 12, which is 1–2 degrees less than the included angle between the tapered outer surface 47 and a horizontal line. Also a circumferential groove 53 is disposed in an upper surface of the central portion 46, which results in a degree of flexibility of an upper part 55 of the portion 46. Thus, as the can 24 is pushed upwardly and the force exerted by the spring 54 is overcome, the upper part 55 of the tapered outer surface 47 is compressed and seals against the sloped surface 51. In addition, the pressure exerted on the portion 46 causes the can valve 32 to open. However, the sealing of the upper part 55 against the sloped surface 47 prevents gel from escaping into the space surrounding the central portion 46.

Thereafter, when it is desired to remove the can 24 from the recess 22, a user need only depress the button 40 to cause the coupling ring 36 to move to the disengaged position whereupon the spring 54, the resilient can valve 32 and a further spring-loaded resilient valve described hereinafter urge the can 24 downwardly out of the recess 22.

Referring to FIGS. 2–5 and 12, the coupling cover 52 includes a series of four legs 56 having outwardly directed flanges 58. The coupling cover 52 is disposed in a ring 60 such that the flanges 58 engage a stepped inner surface of the ring 60. The ring 60 and the coupling cover 52 are disposed in a stepped counterbore 64 in a mounting plate 66 such that an outer flange 62 of the ring 60 abuts a shoulder 68 (FIG. 2) partially defining the counterbore 64. An o-ring 69 provides a seal between the coupling cover 52 and the ring 60.

Figure 12:
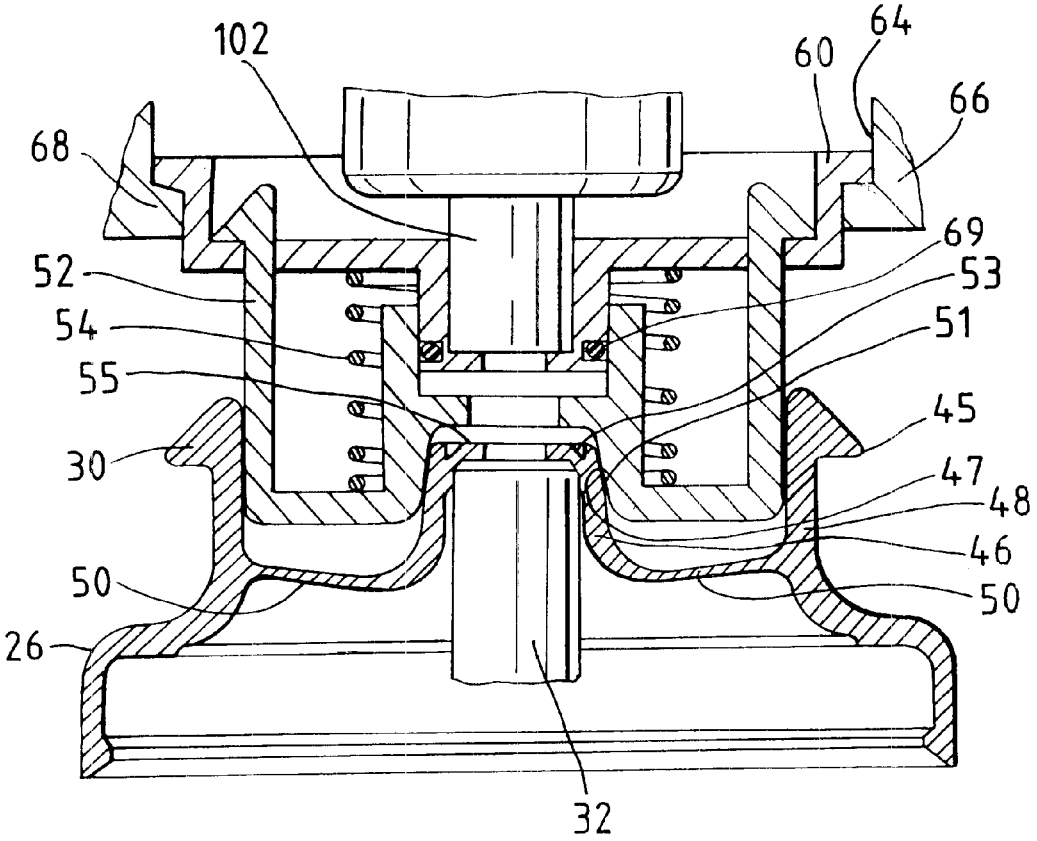
FIG. 12 is an enlarged, fragmentary, full sectional view illustrating the engagement of the coupling cap with the coupling cover.

FIG. 15 illustrates an alternative embodiment wherein structures common to FIGS. 12 and 15 are assigned like reference numerals. In the embodiment of FIG. 15, the coupling cover 52, the spring 54, the ring 60 and the o-ring 69 are replaced by a coupling cover **52*a* that is retained in the stepped counterbore 64. The coupling cover 52*a* is axially movable a short distance owing to a clearance provided between the walls defining the counterbore 64 and a circumferential flange 52*b* of the coupling cover 52*a*. This embodiment relies upon the resiliency of the can valve 32 and the further resilient valve described hereinafter to eject the can 24 from the recess 22**.

Referring again to FIGS. 2–5, the mounting plate 66 further includes a cylindrical hollow insert 70 that is retained by any suitable means in a bore 72. A plunger 74 of a pressure relief valve 76 is disposed together with a spring 78 in the insert 70. The insert 70 is open at both ends and is in fluid communication with an exit tube 80.

Referring to FIGS. 2–5, 10 and 11, a heater assembly 90 is disposed atop the mounting plate 66. The heater assembly includes a heat exchanger 92, a heat distributor plate 93 disposed atop the heat exchanger 92, an electrical resistance heater 94 disposed atop the heat distributor plate 93 and a retainer clip 96 that maintains the elements 92–94 in assembled relationship. The heat exchanger 92 and distributor plate 93 are fabricated of any suitable heat conductive materials, such as copper. The resistance heater 94 preferably comprises a 26 watt resistive element wound on a mica core and is wrapped in electrical insulation. The electrical insulation comprises a resin impregnated with mica wherein the impregnated resin is bonded to a glass cloth. The retainer clip 96 is made of any suitable material, such as stainless steel, and is sufficiently flexible to allow the legs thereof to deform and snap over side walls of the heat exchanger 92 such that raised portions 97 (FIGS. 10 and 11) of the heat exchanger 92 reside in apertures 98 in the clip 96. This interfering fit of the raised portions with the apertures 98 securely fixes the clip 96 and the elements 93 and 94 on the heat exchanger 92.

Figure 8:
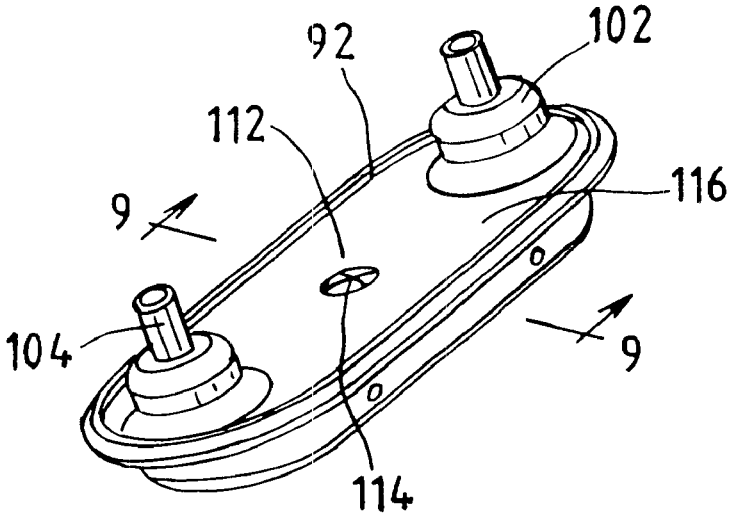
FIG. 8 is an isometric view of an underside of the heat exchanger of FIGS. 2–5.
Figure 9:
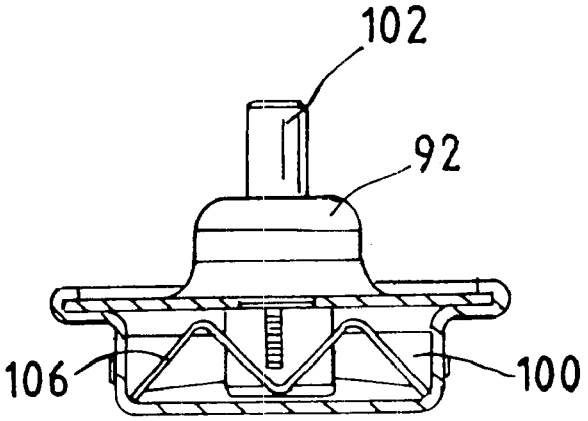
FIG. 9 is a sectional view taken generally along the lines 9—9 of FIG. 8.

Referring also to FIGS. 8 and 9, the heat exchanger 92 includes a chamber 100 therein. A first resiliently biased valve 102 is in fluid communication with a first portion of the chamber 100 and a second resiliently biased valve 104 is in fluid communication with a second portion of the chamber 100. Preferably, each of the first and second valves 102, 104 comprises a conventional valve used in pressurized aerosol cans. Alternatively, one or more of the valves 32, 102 and 104 may be of the type disclosed in U.S. Pat. Nos. 4,442,959; 4,493,444; 4,522,318; and 4,532,690. The heat exchanger 92 also preferably includes a folded internal wall 106 (FIG. 9) that is also preferably made of copper and that serves to increase the heat transfer ability of the heat exchanger 92. It is believed that the folded internal wall 106 may assist in mixing the gel in the heat exchanger 92 to reduce the incidence of localized hot spots or cold spots in the gel. The chamber 100 is sized to accommodate approximately five to seven grams, and, more specifically, approximately six grams of shaving gel.

Referring to FIGS. 2–5 and 8, a washer-shaped gasket 110 is carried by the plunger 74 and bears and seals against a sealing surface 112 (FIG. 8) surrounding an opening 114 in a lower wall 116 (also seen in FIG. 8) of the heat exchanger 92. The plunger 74 is displaceable in a downward direction in response to an undesirably elevated pressure in the chamber 100 to vent material from the chamber out through the tube 80. The pressure at which this relief action takes place is determined in part by the stiffness of the spring 78.

Figure 10:
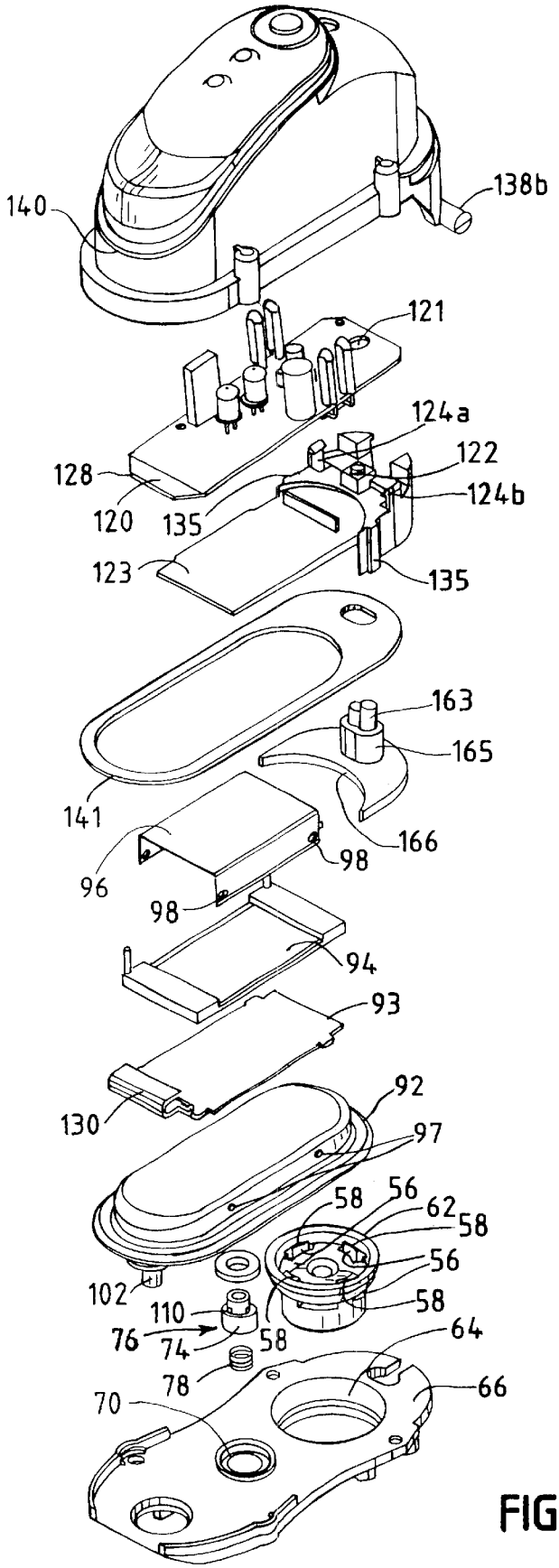
FIG. 10 is an exploded isometric view of various components of FIGS. 2–5 looking down from above.
Figure 11:
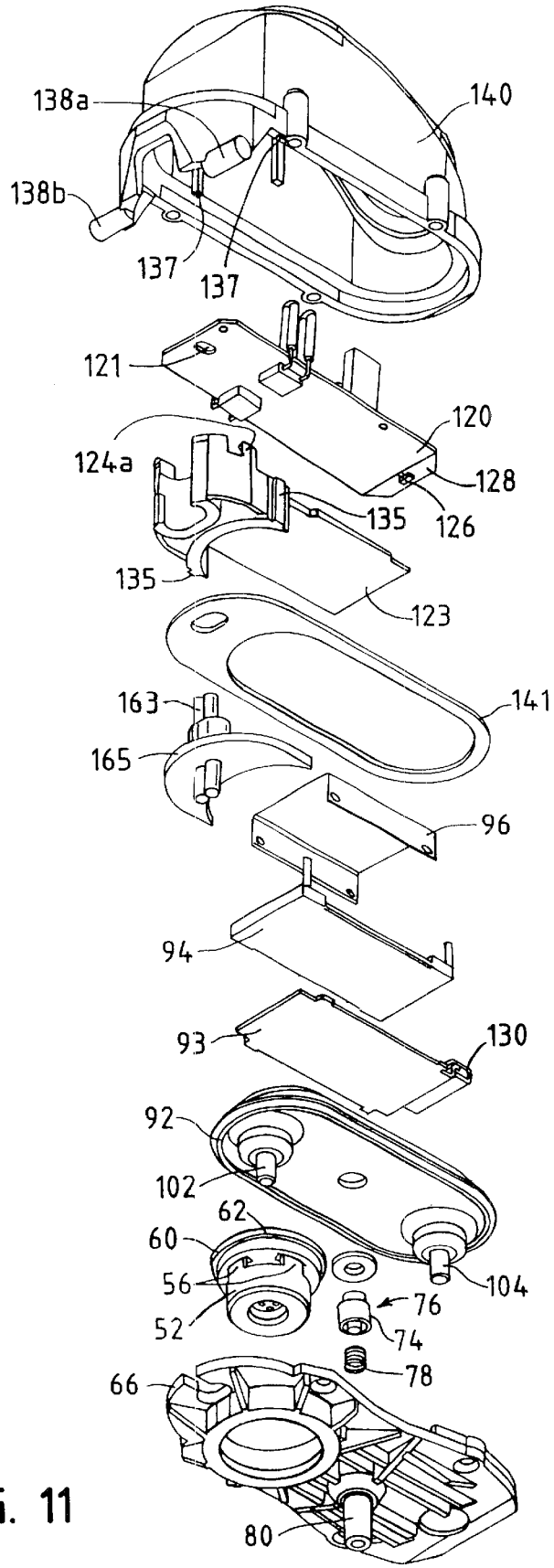
FIG. 11 is an exploded isometric view of the components of FIG. 10 looking up from below.

A printed circuit board 120 includes an aperture 121. The printed circuit board 120 is disposed on an electrically insulative carrier 123 such that a tab 122 is disposed in the aperture 121 and further such that the board 120 is engaged and restrained against movement by the tab 122 and a pair of side clips 124*a,* 124*b*. The printed circuit board 120 mounts the various electrical components shown in FIG. 7 for controlling the heater 94 including a surface-mounted temperature switch 126 (FIGS. 2, 6 and 11). With reference to FIGS. 2, 10 and 11, the temperature switch 126 is mounted at an end 128 of the printed circuit board 120 opposite the aperture 121. The distributor plate 93 includes an extension member 130 that extends outwardly and upwardly and folds back upon itself to surround the end 128 of the printed circuit board 120, and, more particularly, the temperature switch 126. A thermal compound may be provided between the distributor plate 93 and the heat exchanger 92 to enhance thermal conductivity therebetween. Preferably, the thermal compound comprises Chemplex 1381 heat sink silicone sold by NFO Technologies, a division of Century Lubricants Co. of Kansas City, Kans. A sheet of electrical insulation 131 is also provided between the extension member 130 and the temperature switch 126 to provide electrical isolation of the switch 126. The sheet 131 further extends rearwardly between the carrier 123 and the clip 96. This arrangement ensures that electrical isolation is provided for the printed circuit board 120 and further ensures that the temperature switch 126 is exposed to a temperature representative of the temperature of the heater 94.

If desired, the distributor plate 93 may be omitted and the heat exchanger 92 may be provided with an extension member like the member 130.

The mounting plate 66 is secured to an inner enclosure member 140 by any suitable means, such as screws, thereby capturing the heater assembly 90 within the member 140. In this regard, the carrier 123 includes ribs 135 (FIGS. 10 and 11) that fit within slots 137 (FIG. 11 only) of the member 140 to restrain the various components against substantial movement. A gasket 141 is provided between the heat exchanger 92 and the inner enclosure member 140 to prevent passage of material into the space above the heat exchanger 92.

Figure 13:
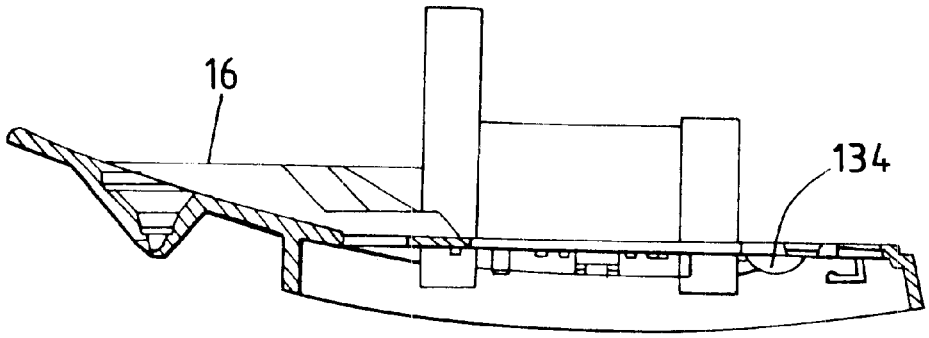

The inner enclosure member 140 is mounted for pivoting movement about a pivot axis 142 (FIG. 3) within the upper portion 18 of the housing 12 (FIG. 2). Specifically, as seen in FIGS. 13 and 14, the collar portion 16 includes a pair of semicircular recesses 134 that mate with aligned semicircular recesses 136 in the upper portion 18 to form cylindrical bores that accept a pair of axles 138*a* and 138*b* (FIGS. 3, 5, 10 and 11) of the inner enclosure member 140. The upper portion 18 of the housing 12 includes an aperture 143 (FIG. 4) through which an actuator member 144 of the inner enclosure member 140 extends. Preferably, the inner enclosure member is fabricated using a two-shot molding process wherein a main part 145 of the inner enclosure member 140 is first molded of polycarbonate and thereafter the actuator member 144 is molded onto the main part 145. Preferably, the actuator member is made of low modulus TPE. Pushing down on the actuator member 144 results in pivoting of the member 140, the heater assembly 90 and the mounting plate 66 about the pivot axis 142. This pivoting of the heater assembly 90 with respect to the upper portion 18 causes the second valve 104 to push down on walls 150 of the collar portion 16 surrounding an exit 152 (FIG. 2), thereby resulting in opening of the second valve 104 and dispensing of heated gel from the chamber 100.

Molded in the actuator member 144 is a flexible push-button 156 having a downwardly depending portion that is engageable with a switch SW1 (FIG. 6) carried by the printed circuit board 120. First and second lenses 160 and 162 (FIG. 3) are molded as part of the member 140 and are adapted to transmit light produced by two light-emitting diodes LED1 and LED2 (FIGS. 2, 3 and 7), respectively. Electrical power for the electrical components is supplied over a power cord 163 (FIGS. 10 and 11) that extends from the printed circuit board 120 through a bore in the gasket 141 behind the heat exchanger 92 and a power cord cover 164 and outwardly from the main body portion 14. A grommet 165 is molded as part of the power cord 163 and includes a curved surface 166 (FIG. 10) that fits against a correspondingly-shaped end wall of the heat exchanger 92.

Figure 7:
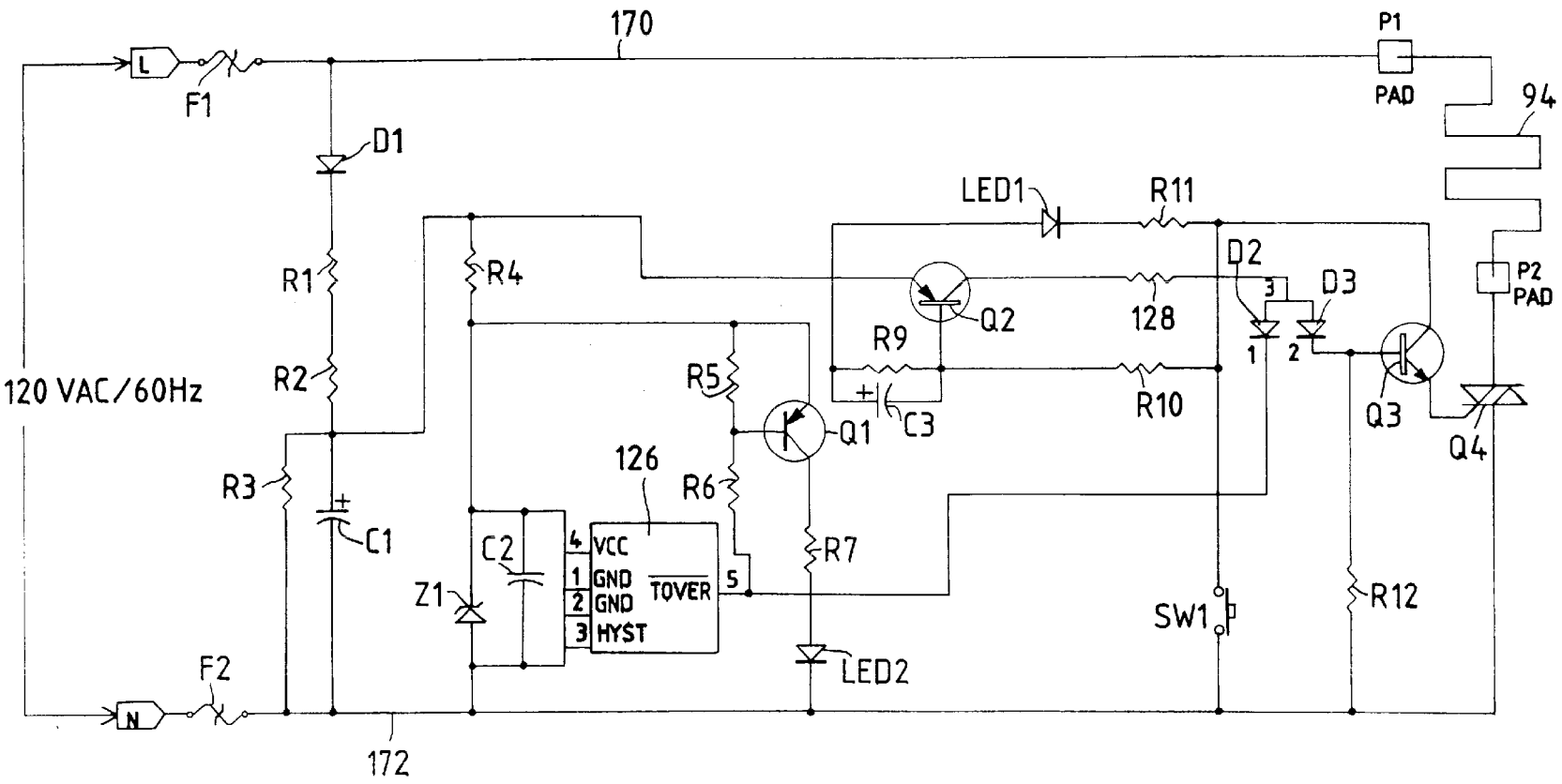
FIG. 7 is a circuit diagram of a control circuit used in the apparatus of FIGS. 1–5.

FIG. 7 illustrates the electrical circuitry for operating the heater 94. Electrical power is applied through first and second thermal fuses F1 and F2 to first and second conductors 170, 172. Resistors R1, R2, R3 and R4, diode D1, zener diode Z1 and capacitors C1 and C2 provide a stable voltage source of predetermined magnitude for the temperature switch 126. In the preferred embodiment, the temperature switch 126 comprises a MAX6501 micropower temperature switch manufactured by Maxim Integrated Products of Sunnyvale, Calif. An output of the temperature switch 126 is coupled to a transistor Q1 suitably biased by resistors R5 and R6. A resistor R7 and the diode LED2 are connected in series between the collector of the transistor Q1 and the conductor 172. The output of the temperature switch 126 is also coupled to a diode D2, which is, in turn, connected to a collector of a transistor Q2 through a resistor R8. The transistor Q2 includes an emitter coupled to a junction between the resistors R2 and R3. A resistor R9 and a capacitor C3 are connected across the base and emitter of the transistor Q2. A resistor R10 is coupled between the base of the transistor Q2 and a collector of a transistor Q3. The collector of the transistor Q3 is also coupled to the emitter of the transistor Q2 by a resistor R11 and the diode LED1.

The switch SW1 has a first end coupled to a junction between the resistors R10 and R11 and further has a second end coupled to the conductor 172. In addition, a diode D3 is connected between the resistor R8 and the base of the transistor Q3 and the latter is further coupled to the conductor 172 by a resistor R12. The emitter of the transistor Q3 is coupled to a control electrode of the triac Q4, which in turn further includes main current path electrodes connected in series with the heater 94 between the conductors 170 and 172.

Industrial Applicability

In operation, the can of pressurized shaving gel 24 is inserted into the recess 22 until the coupling ring 36 snaps into the engaged position as noted above, thereby locking the can 24 in the recess 22. The power cord for the dispensing apparatus 10 is then plugged into a standard wall outlet (if it is not already plugged in). In this regard, the thermal fuses F1 and F2 are positioned on the printed circuit board 120 so that, in the event of a component failure causing the heater to experience a thermal runaway condition, one or both of the fuses F1 and F2 disconnects the power from the circuitry on the printed circuit board. In addition, the fuses F1 and F2 are disposed on the printed circuit board 120 proximate the resistors R1 and R2 so that, in the event that the power cord is plugged into a wall outlet supplying power at other than the 120 rated volts for the unit (such as 252 volts), the resistors R1 and R2 develop a magnitude of heat sufficient to cause one or both of the fuses F1 and F2 to disconnect the power from the balance of the circuitry on the printed circuit board 120. Of course, the fuses F1 and F2 must be rated and positioned on the printed circuit board so that a 120 volt application of power does not cause inadvertent tripping of the fuses F1 and F2.

Referring to FIGS. 2 and 6, once the power cord is plugged in the user may depress the pushbutton 156, in turn closing the switch SW1, whereupon the diode LED1 is energized by the gating of current through the diode D1, the resistors R1, R2 and R11 and the switch SW1. In addition, closing the switch SW1 turns on the transistor Q2. However, the transistor Q3 and the triac Q4 are maintained in an off condition while the switch SW1 is closed so that a user cannot cause continuous energization of the heater 94 by continuously holding down the pushbutton 156. Thereafter, upon release of the pushbutton 156, the transistor Q3 is turned on through the diode D3. In addition, upon initial closure of the switch SW1, and until the time that the temperature switch 126 detects a first temperature magnitude, such as approximately 130 degrees F., an output TOVER(bar) is in a high state. Therefore, the triac Q4 turns on and remains on to energize the heater 94 following release of the switch SW1 owing to the continued on state of the transistors Q2 and Q3 and the high state status of the output TOVER(bar). The heater 94 continues to heat until the first temperature magnitude is detected by the temperature switch 126, whereupon the output TOVER(bar) switches to a low state. Upon this occurrence, the junction between the diodes D2 and D3 is pulled low, thereby turning off the transistors Q2 and Q3 and the triac Q4 so that current flow through the heater 94 is interrupted. In addition, the transistor Q1 is turned on, thereby causing the diode LED2 to illuminate. In the preferred embodiment, the diode LED1 is red in color and the LED2 is green in color.

The dispensing apparatus 10 is designed so that the gel remains above a particular temperature (such as 125 degrees F.) for a period of time (such as 2 minutes) after heating. As should be evident from the foregoing, the temperature sensed by the switch 126 is representative of (but not exactly equal to) the temperature of the gel. Preferably, although not necessarily, the temperature sensed by the switch 126 should remain within a tolerance band of no greater than five degrees F. below the temperature of the gel. Also, the control circuit preferably controls the temperature of the gel to within ±5 degrees F. of a set point of 130 degrees F. Once the temperature switch 126 detects a temperature below a second temperature magnitude, such as approximately 125 degrees F., the output TOVER(bar) reverts to the high state, thereby turning the LED2 off. The apparatus 10 is thus in a state ready to be actuated by depressing the switch SW1 again, thereby initiating another heating sequence.

As should be evident from the foregoing, once the pushbutton 156 is depressed and released the heater 94 is energized. During this time the red LED1 is energized to alert the user that heating is occurring. This operation continues until a certain temperature is reached, whereupon the heater 94 is deenergized and the red LED1 is turned off and the green LED2 is turned on. The green LED2 remains in the energized state informing the user that the gel is ready for dispensing until the temperature sensed by the temperature switch 126 drops below the second temperature magnitude. Significantly, the heater 94 remains deenergized until the pushbutton 156 is again depressed, thereby providing an auto-shutoff feature that contributes to the safety of the apparatus 10.

Because the heater 94 heats the heat exchanger 92 and the gel through the distributor plate 93, the heat exchanger 92 and the gel contained therein cannot be heated to a temperature higher than the distributor plate 93. Also, inasmuch as the temperature switch 126 is closely thermally coupled to the distributor plate 93, the temperature of the plate 93 is accurately controlled, and the relatively high thermal mass of the plate 93 results in accurate tracking of the gel temperature with the temperature of the plate 93 with only short time lags. Accuracy is further enhanced by the isolation of the temperature switch 126 from the surrounding environment (except for the temperature of the plate 93). This is achieved by disposing the temperature switch 126 at an end of the printed circuit board 120 remote from the balance of the circuitry carried by the board 120 and providing serpentine electrical connections to the temperature switch 126. Further thermal isolation is accomplished by surrounding the temperature switch 126 with the extension member 130. Still further accuracy is afforded by the use of the temperature switch 126 itself, inasmuch as such device has a low thermal mass that does not require significant energy to heat or cool.

It should be noted that the dispensing apparatus 10 is compact yet capable of accommodating various can sizes. This ability is at least partially afforded by the size of the recess 22 and the positive locking of the can 24 therein by the coupling ring 36. In the preferred embodiment, a wide range of can sizes can be accommodated, such as cans between 0.50 inch and 4.00 inches in diameter and 1.00 inch and 8.00 inches in height, although any can size could be used provided that the dispensing apparatus 10 is appropriately designed to accept such can size.

The present invention comprehends a shave gel heating system that minimizes post-foaming of the gel prior to dispensing thereof. This is achieved by using a post foaming component in the gel formulation (preferably isopentane alone without isobutane) that exhibits a relatively low vapor pressure (as compared with gel formulations not intended to be heated) and by employing a closed heating system that keeps the heated gel under can pressure until the gel is dispensed.

It should be noted that the present invention may be modified by omitting the valve 102, in which case suitable sealing apparatus evident to one of ordinary skill in the art would be provided between the can valve 32 and the heat exchanger to allow the gel in the heat exchanger to be maintained at can pressure.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. Apparatus for dispensing a heated gel, comprising:

a housing having a recess therein;

a coupling assembly disposed in the housing and adapted to retain a pressurized gel container in the recess;

a heater assembly disposed in the housing and including a heater selectively operable to develop heat and a heat exchanger in heat transfer relationship with the heater and having a chamber for receiving a quantity of gel, the heater assembly further including a first valve in fluid communication with a first portion of the chamber and operable to expose the chamber to pressurized gel and a second valve in fluid communication with a second portion of the chamber and operable to allow dispensing of gel without substantial foaming.

2. The apparatus of claim 1, wherein the heater is operated by a control circuit.

3. The apparatus of claim 2, wherein the control circuit is disposed on a printed circuit board disposed above the heater.

4. The apparatus of claim 3, wherein the control circuit includes a temperature sensor and wherein the heat exchanger is in thermal contact with an extension member that surrounds the temperature sensor.

5. The apparatus of claim 1, further including a pressure relief valve in fluid communication with the chamber.

6. The apparatus of claim 1, wherein the coupling assembly comprises a spring-loaded coupling ring adapted to engage a coupling cap.

7. The apparatus of claim 1, wherein the first valve is resiliently biased.

8. The apparatus of claim 1, in combination with a can of pressurized gel retained in the recess by the coupling assembly.

9. The apparatus of claim 8, wherein the can includes a coupling cap engaged by the coupling assembly.

10. The apparatus of claim 9, wherein the coupling assembly comprises a coupling ring that engages a flange of the coupling cap.

11. The apparatus of claim 10, wherein the can includes a can valve and wherein the first valve and the can valve are resiliently biased and the can valve engages the first valve to urge the can valve and the first valve to open positions against such resilient biasing when the coupling ring engages the flange of the coupling cap.

12. A combination of a dispensing apparatus and a can of pressurized shaving gel, comprising:

the can including a can valve and a coupling cap having a circumferential flange; and the dispensing apparatus including a housing having a recess therein wherein the can is disposed in the recess, a coupling assembly disposed in the housing and engaging the circumferential flange of the coupling cap, a heater assembly disposed in the housing and including a heater selectively operable to develop heat and a heat exchanger in heat transfer relationship with the heater and having a chamber, the heater assembly further including a first valve in fluid communication with a first portion of the chamber and engageable to move the can valve and the first valve to open positions to expose the chamber to pressurized shaving gel and a second valve in fluid communication with a second portion of the chamber and operable to allow dispensing of gel without substantial foaming.

13. The combination of claim 12, wherein the heater is operated by a control circuit.

14. The combination of claim 13, wherein the control circuit is disposed on a printed circuit board disposed above the heater.

15. The combination of claim 14, wherein the control circuit includes a temperature sensor and wherein the heat exchanger is in thermal contact with an extension member that surrounds the temperature sensor.

16. The combination of claim 12, further including a pressure relief valve in fluid communication with the chamber.

17. The combination of claim 12, wherein the coupling assembly comprises a spring-loaded coupling ring movable between a first position at which the coupling ring is in interfering relationship with the circumferential flange and a second position at which the coupling ring is disengaged from the circumferential flange.

18. The combination of claim 12, wherein the first valve is resiliently biased.

19. The combination of claim 12, wherein the heater assembly is pivotally mounted in an enclosure member and wherein the second valve is operated by pushing on a top surface of the enclosure member.

20. The combination of claim 12, wherein the heater assembly is pivotable to cause the first valve to engage the can valve such that the can valve and the first valve are moved to the open positions and further to cause the second valve to be opened.

21. A method of dispensing a heated gel, the method comprising the steps of:

providing a housing having a recess therein and a heater assembly disposed in the housing wherein the heater assembly includes a heater selectively operable to develop heat and a heat exchanger in heat transfer relationship with the heater and having a chamber, the heater assembly further including a first valve in fluid communication with the chamber and a second valve operable to permit fluid flow out of the chamber;

placing a quantity of pressurized gel in fluid communication with the first valve;

opening the first valve to expose the chamber to pressurized gel; and opening the second valve to allow dispensing of gel without substantial foaming.

22. The method of claim 21, wherein the step of placing comprises the steps of providing a container of pressurized gel having a container valve and positioning the container such that the first valve and the container valve are opened and placed in fluid communication with one another.

23. The method of claim 22, wherein the step of positioning the container comprises the step of inserting the container in the recess until a coupling ring engages a coupling cap carried by the container.

24. The method of claim 23, wherein the coupling ring is urged toward a particular position by a force exerted by a spring and wherein the step of inserting includes the step of exerting pressure on the can to displace the coupling ring against the force exerted by the spring until the coupling ring travels over a flange of the coupling cap and is moved toward the particular position by the force exerted by the spring.

25. The method of claim 21, wherein the step of opening the first valve includes the step of maintaining the second valve in a closed condition during the opening of the first valve.

26. The method of claim 21, wherein the heater assembly includes a control circuit having a temperature sensor and including the further step of providing an extension member that surrounds the temperature sensor wherein the extension member is in thermal contact with the heat exchanger.

27. The apparatus of claim 21, including the further step of providing a pressure relief valve in fluid communication with the chamber.

28. A method of dispensing a heated gel, the method comprising the steps of:

providing a housing having a recess therein and a heater assembly disposed in the housing wherein the heater assembly includes a heater selectively operable to develop heat, a control circuit that controls the heater and a heat exchanger in heat transfer relationship with the heater and having a chamber, the heater assembly further including a first valve in fluid communication with the chamber and a second valve operable to permit fluid flow out of the chamber;

positioning a container of pressurized gel having a container valve such that the first valve and the container valve are opened and placed in fluid communication with one another such that the chamber is exposed to pressurized gel; and opening the second valve to allow dispensing of gel without substantial foaming.

29. The method of claim 28, wherein the step of positioning the container comprises the step of inserting the container in the recess until a coupling ring engages a coupling cap carried by the container.

30. The method of claim 29, wherein the coupling ring is urged toward a particular position by a force exerted by a spring and wherein the step of inserting includes the step of exerting pressure on the can to displace the coupling ring against the force exerted by the spring until the coupling ring travels over a flange of the coupling cap and is moved toward the particular position by the force exerted by the spring.

31. The method of claim 30, wherein the step of positioning includes the step of maintaining the second valve in a closed condition during the opening of the first valve.

32. The method of claim 31, wherein the control circuit includes a temperature sensor and including the further step of providing an extension member that surrounds the temperature sensor wherein the extension member is in thermal contact with the heat exchanger.

33. The apparatus of claim 32, including the further step of providing a pressure relief valve in fluid communication with the chamber.

* * * * *